US010232988B2

(12) United States Patent
Cox

(10) Patent No.: US 10,232,988 B2
(45) Date of Patent: Mar. 19, 2019

(54) DISPENSING CAP

(71) Applicant: Obrist Closures Switzerland GmbH, Reinach (CH)

(72) Inventor: Thomas Peter Cox, Norwich Norfolk (GB)

(73) Assignee: Obrist Closures Switzerland GmbH, Reinach (CH)

( * ) Notice: Subject to any disclaimer, the term of this patent is extended or adjusted under 35 U.S.C. 154(b) by 98 days.

(21) Appl. No.: 14/909,921

(22) PCT Filed: May 8, 2014

(86) PCT No.: PCT/GB2014/051403
§ 371 (c)(1),
(2) Date: Feb. 3, 2016

(87) PCT Pub. No.: WO2015/019041
PCT Pub. Date: Feb. 12, 2015

(65) Prior Publication Data

US 2016/0185493 A1 Jun. 30, 2016

(30) Foreign Application Priority Data

Aug. 8, 2013 (GB) ..... 1314207.0

(51) Int. Cl.
*B65D 47/06* (2006.01)
*B65D 47/08* (2006.01)
(Continued)

(52) U.S. Cl.
CPC ..... *B65D 47/065* (2013.01); *B65D 47/0847* (2013.01); *B65D 47/0876* (2013.01);
(Continued)

(58) Field of Classification Search
CPC ..... B65D 47/065; B65D 51/223; B65D 47/0876; B65D 47/0895; B65D 51/222;
(Continued)

(56) References Cited

U.S. PATENT DOCUMENTS 1,389,733 A 9/1921 Baron
4,934,590 A 6/1990 Robichaud et al.
(Continued)

FOREIGN PATENT DOCUMENTS

DE 102010015002 B3 4/2011
GB 2345688 A 7/2000
(Continued)

OTHER PUBLICATIONS

European Patent Office, Office Action Issued in Application No. 14725757.0, dated May 26, 2017, Netherlands, 6 pages.
(Continued)

*Primary Examiner* — James N Smalley
(74) *Attorney, Agent, or Firm* — McCoy Russell LLP

(57) ABSTRACT

A dispensing cap comprising a dispensing orifice and an anti-glug orifice, the cap further comprising a closure member movable from a closed position to an open position, in which in the closed position the anti-glug orifice is blocked by the closure member and the dispensing orifice is closed, and in the open position the dispensing orifice is open and the anti-glug orifice is unblocked.

20 Claims, 7 Drawing Sheets

(51) Int. Cl.
*B65D 47/32* (2006.01)
*B65D 47/40* (2006.01)
*B65D 51/22* (2006.01)

(52) U.S. Cl.
CPC ..... *B65D 47/0895* (2013.01); *B65D 47/32* (2013.01); *B65D 47/40* (2013.01); *B65D 51/222* (2013.01); *B65D 51/223* (2013.01); *B65D 2251/0025* (2013.01); *B65D 2251/0093* (2013.01)

(58) Field of Classification Search
CPC .... B65D 47/40; B65D 47/32; B65D 47/0847; B65D 2251/0093; B65D 2251/0025
USPC ..... 220/254.3, 266, 367.1, 212, 253; 222/541.1, 541.2, 541.5, 541.6, 81, 83; 229/215.04, 125.15
See application file for complete search history.

(56) References Cited

U.S. PATENT DOCUMENTS 5,947,316 A * 9/1999 Guillonnet ..... B65D 5/748 220/269
6,257,449 B1 * 7/2001 Baerenwald ..... B65D 5/748 220/267
6,257,452 B1 7/2001 Allen
6,554,181 B1 * 4/2003 Dammers ..... B65D 5/748 220/267
6,702,137 B1 * 3/2004 Kowa ..... A47J 41/0027 215/235
2002/0014502 A1 * 2/2002 Taylor ..... B65D 5/748 222/556
2004/0182890 A1 * 9/2004 Rudolph ..... B29C 45/0017 222/556
2004/0200836 A1 10/2004 Hierzer et al.
2006/0196893 A1 9/2006 Hierzer
2007/0131689 A1 * 6/2007 Felber ..... B65D 5/748 220/254.3
2008/0035637 A1 2/2008 Shehadey et al.
2008/0087690 A1 4/2008 Parve
2008/0110849 A1 5/2008 Wachsberg
2012/0181303 A1 * 7/2012 Swanick ..... B65D 47/305 222/83
2012/0228295 A1 * 9/2012 Emircan ..... B65D 5/747 220/254.1
2012/0255952 A1 * 10/2012 Knierbein ..... B65D 47/066 220/278
2015/0225133 A1 * 8/2015 Emircan ..... B65D 5/748 220/254.8

FOREIGN PATENT DOCUMENTS

WO 9921767 A1 5/1999
WO 2007138350 A1 12/2007

OTHER PUBLICATIONS

Intellectual Property Office of Great Britain, Search Report Issued in Patent Application No. GB1314207.0, dated Oct. 22, 2013, South Wales, 5 pages.
ISA European Patent Office, Invitation to Pay Additional Fees and, Where Applicable, Protest Fee Issued in Application No. PCT/GB2014/051403, dated Jul. 8, 2014, WIPO, 5 pages.
ISA European Patent Office, International Search Report and Written Opinion Issued in Application No. PCT/GB2014/051403, dated Sep. 10, 2014, WIPO, 16 pages.

* cited by examiner

DISPENSING CAP

CROSS REFERENCE TO RELATED APPLICATIONS

The present application is a U.S. National Phase of International Patent Application Serial No. PCT/GB2014/051403, entitled "A DISPENSING CAP," filed on May 8, 2014,which claims priority to Great Britain Patent Application No. 1314207.0, filed on Aug. 8, 2013, the entire contents of each of which are hereby incorporated by reference for all purposes.

FIELD OF THE INVENTION

The present invention relates generally to a cap and specifically to a dispensing cap from which flowable product can be dispensed from an associated container or the like.

BACKGROUND OF THE INVENTION

Dispensing closures are widely used for closing an opening in a container and allowing product to be dispensed from the container. The present invention seeks to provide improvements in or relating to dispensing closures.

According to a first aspect of the present invention there is provided a dispensing cap comprising a dispensing orifice and an anti-glug orifice, the cap further comprising a closure member movable from a closed position to an open position, in which in the closed position the anti-glug orifice is blocked by the closure member and the dispensing orifice is closed, and in the open position the dispensing orifice is open and the anti-glug orifice is unblocked.

The anti-glug orifice is therefore revealed during opening. Thereafter when product flows through the dispensing orifice the anti-glug system helps with the problem of inconsistent flow rates and inaccurate pouring. The anti-glug orifice allows air to enter the container, equalising the pressure inside and outside the container to give a more consistent flow of product. In some embodiments a spout initially seals and emerges from an anti-glugging orifice.

A further aspect provides a dispensing cap comprising a dispensing orifice and a closure member movable from a closed position in which the orifice is closed to an open position in which the orifice is open, the closure member including a pouring spout which is moved so as to be able to receive flow from the dispensing orifice in the open position.

In some embodiments a pouring spout therefore forms part of the closure member and as the closure member is moved to open the dispensing orifice the spout moves to a position so that is can receive product flow from the orifice.

A further aspect provides a dispensing cap comprising a dispensing orifice and a closure member movable from a closed position in which the orifice is closed to an open position in which the orifice is open, the cap includes a body closed at or towards one end by the member, and the closure member is pivotable about a lateral axis of the body to open the dispensing orifice.

In some embodiments the lateral axis is generally perpendicular to a main axis of the body. The lateral axis may be generally centrally positioned on the body.

A further aspect provides a dispensing cap comprising a dispensing orifice and a closure member movable from a closed position in which the orifice is closed to an open position in which the orifice is open, the cap includes a body closed at or towards one end by the member, and the closure member is inverted to open the dispensing orifice.

In some embodiments the closure member is moved away from the dispensing orifice to open it. In other embodiments the closure member is responsible for an opening event e.g. breaching a seal or breaking a cover.

The closure member may include breaching means for breaching a container seal, such as cutting or slicing means.

The breaching means may be arranged to breach the seal at or in the region of an outside diameter thereof. In some embodiments a generally circular seal is used to seal a container opening. In many cases, such seals are most taut at their outside diameter and by cutting at this point a very clean and efficient cut can be achieved.

The closure member may be movable from the closed to the open position in a one-handed user operation.

In some embodiments the cap may be formed as a single-piece article. In other embodiments multi, for example two, part structures are envisaged, for example with a body part and a closure member part. Use of different materials, for example plastics materials, is possible; a sequentially moulded article may be produced in some embodiments.

The closure member may turn through approximately 180 degrees from the closed to the open position. Embodiments in which the closure member turns to a greater or lesser extent are also possible.

The closure member may be located substantially completely within the periphery of the cap in the closed position. Alternatively or additionally the closure member may be located substantially completely within the periphery of the cap in the open position. In some embodiments therefore there is no increase in the footprint of the cap when the closure member moves to the open position.

The cap may be generally cylindrical, for example having a generally cylindrical side skirt closed at one end by a circular top deck or plate.

The cap may include engagement means for attaching it to a container, for example screw thread formations or a snap bead which engage corresponding formations on a container neck finish.

The present invention also provides a milk container cap comprising or including a cap as defined and described herein.

The present invention also provides a container in combination with a cap as defined and described herein.

The container may have an opening initially closed by a seal. The seal may be applied to the opening by heat sealing, for example by induction heat sealing.

Different aspects of the present invention may be used separately or together.

Further particular and preferred aspects of the present invention are set out in the accompanying independent and dependent claims. Features of the dependent claims may be combined with the features of the independent claims as appropriate, and in combination other than those explicitly set out in the claims.

The present invention will now be more particularly described, by way of example, with reference to the accompanying drawings, in which:

DESCRIPTION

Figure 1:
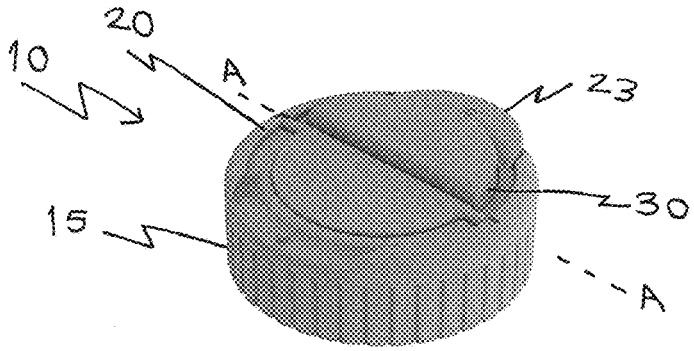
FIG. 1 is a perspective view of a cap formed according to the present invention and shown in a closed position.
Figure 2:
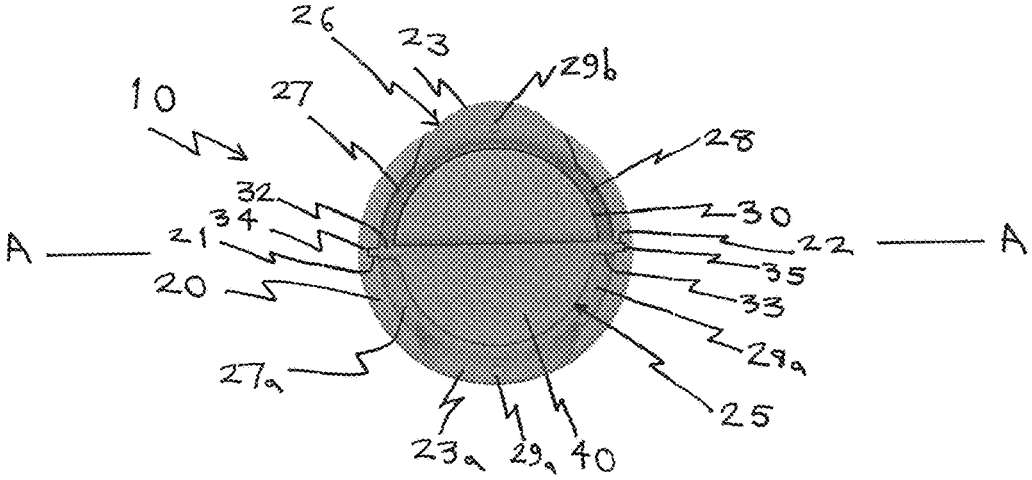
FIG. 2 is a plan view of the cap of FIG. 1.
Figure 3:
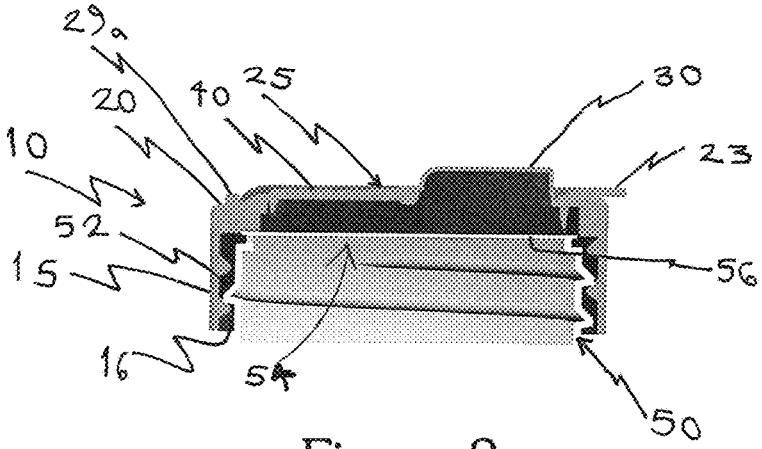
FIG. 3 is a section of the cap of FIGS. 1 and 2.

Referring first to FIGS. 1 to 3 there is shown a cap 10 formed in accordance with the present invention.

The cap 10 comprises a generally cylindrical sidewall 15 which is open at one end and at the other end terminates with a flange 20 which extends radially inwards. The flange 20 carries a closure member 25 and a semi-circular raised deck 30.

The closure member 25 comprises a pouring spout section 26 including two arcuate arms 27, 28 connected to a crescent-shape tab 23. The spout and arms extend around the curved part of the deck 30.

Figure 4:
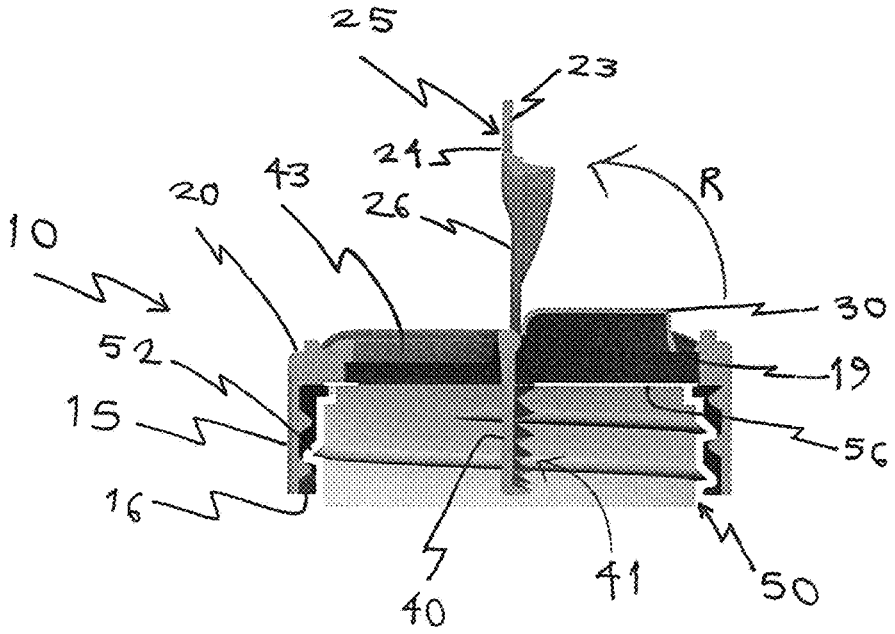
FIG. 4 is a section of the cap of FIG. 3 with a closure member shown in a position between closed and open positions.
Figure 6:
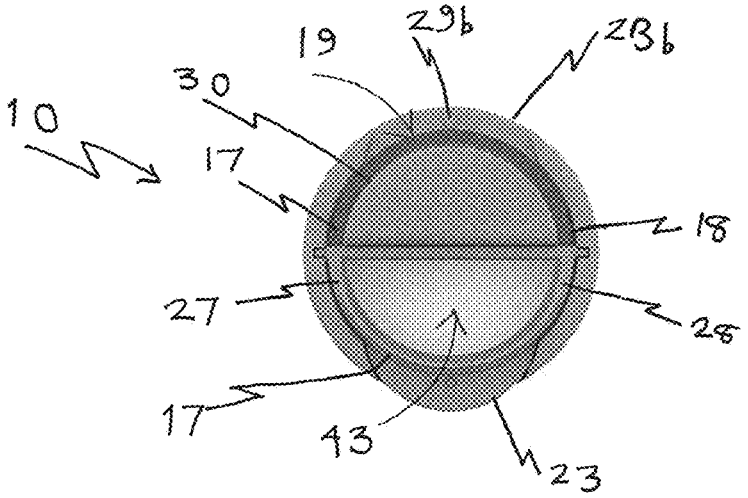
FIG. 6 is a plan view of the cap of FIG. 5.

The deck is only connected to the flange 20 by a pair of central connectors 17, 18, as shown in FIG. 6, and this creates an arcuate gap 19 between the flange and the deck (shown best in FIGS. 4 and 6). The spout 26 and arms 27, 28 are seated in the gap 19 in the closed position.

The arms 27, 28 join the spout 26 to central, laterally extending pivot arms 32, 33. Each arm 32, 33 carries a pivot pin 34, 35. The pins 34, 35 clip into rebates 21, 22 in the flange 20.

The flange 20 supports a recess on the opposite side of the cap which has parts 27*a*, 28*a* and 23*a* shaped correspondingly with the arms 27, 28 and a tab 23 forming part of the spout 26.

At the other side of the arms 32, 33 a semi-circular cutting plate 40 is provided. The periphery of the curved part of the plate 40 is provided with a plurality of cutting teeth 41, as shown in FIG. 4.

Figure 5:
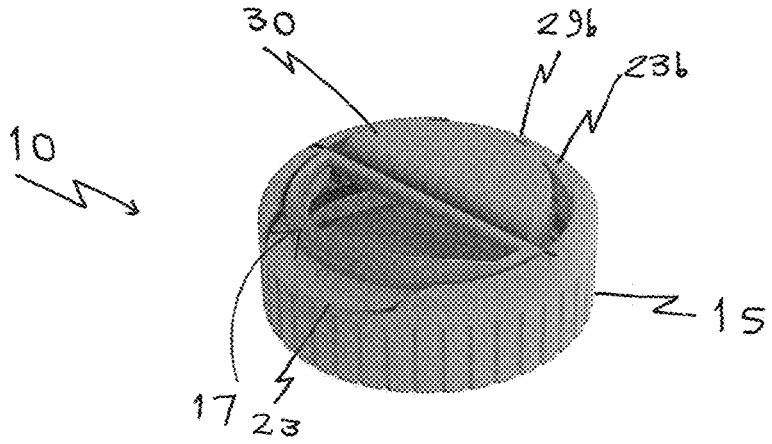
FIG. 5 is a perspective view of the cap of FIGS. 1 to 4 shown in an open position.

The flange 20 also has a recess 23*b*, as shown in FIG. 5, shaped correspondingly to the spout tab 23 opposite the recess part 23*a* . In the closed position the spout tab 23 rests in the recess 23*b*.

The recesses 23*a*, 23*b* have central projections 29*a*, 29*b* which are received in a hole 24 in the spout tab 23.

In FIG. 3 the cap 10 is shown fitted to a container neck 50. For this purpose the interior of the cap sidewall 15 is provided with a screw thread 16 and the neck 50 has a corresponding external screw thread 52 so that the cap can be screwed onto the neck. The circular neck opening 54 is closed by a seal 56, which in this embodiment is a laminar panel in the form of an induction heat sealed seal.

As shown in FIG. 4, if the spout tab 23 is lifted the whole closure 25 pivots in the direction R about the lateral axis A as the pins 34, 35 rotate in the rebates 21, 22. The spout 26 and arms 27, 28 are lifted out of the gap 19. There is no or substantially no relative movement between the two halves of the closure, so as the spout and arms rotate "up" the cutting plate 40 starts to rotate "down".

As the plate 40 rotates the teeth 41 contact the container seal 56 and cut through it. The closure is further rotated to complete the cutting. As the cutting plate moves a dispensing orifice 43 is defined.

Figure 7:
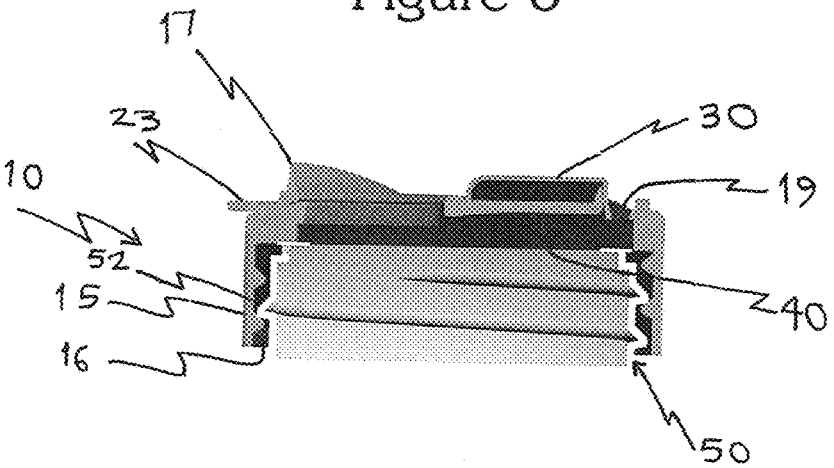
FIG. 7 is a section of the cap of FIGS. 5 and 6.

In the open position shown in FIGS. 5 to 7 the closure has been rotated approximately 180 degrees. The spout tab fits into the flange recess 23*a* and the underside of the spout is shown to have a curved upstanding wall 17 (also referred to as central connector 17) which now sits around the newly formed dispensing orifice and serves as a pouring lip over which product can flow in use. The cutting teeth fit up inside the underside of the deck 30. The gap 19 is unblocked and can serve as an anti-glug orifice in use.

The closure member is therefore "flipped" over and in this embodiment is inverted. The flipping causes cutting of a seal, creation of a dispensing orifice, positioning of a pouring spout adjacent the dispensing orifice and unblocking of an anti-glug orifice.

Referring now to FIGS. 8 to 14 there is shown a cap 110 formed according to an alternative embodiment.

The cap 110 has similar functionality to the cap 10, but in this embodiment is formed as a single moulded piece.

Figure 8:
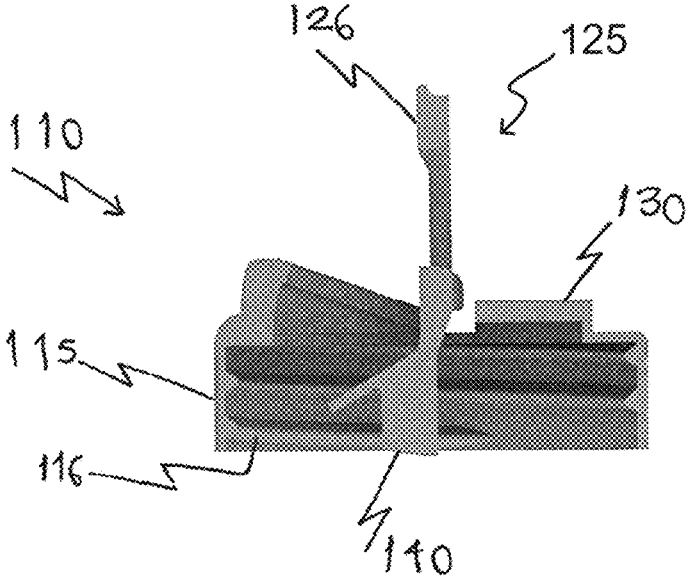
FIG. 8 is a section of a cap formed according to an alternative embodiment and shown in an as-moulded condition.

The cap 110 is initially formed in the position shown in FIG. 8 in which a closure member 125 is in a position intermediate its open and closed positions. Again the closure member includes a cutting plate part 140 and a spout part 126, as well as general cylindrical sidewall 115 and screw thread 116.

Figure 9:
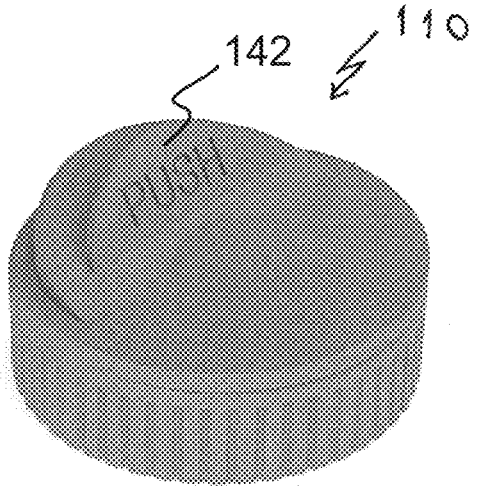
FIG. 9 is a perspective view of the cap of FIG. 8 shown in a closed position.
Figure 10:
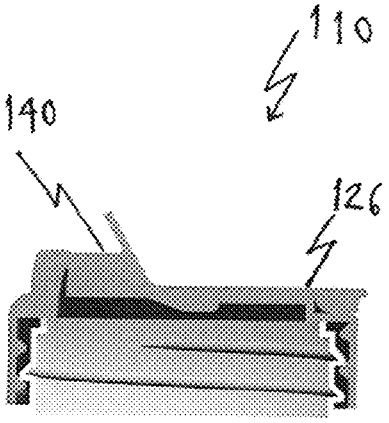
FIG. 10 is a section of the cap of FIG. 9.

Following production the cap is moved to the closed position shown in FIGS. 9 and 10 so that the cutting plate part seats in a dispensing orifice and the spout part 126 fits around the deck 130.

Figure 11:
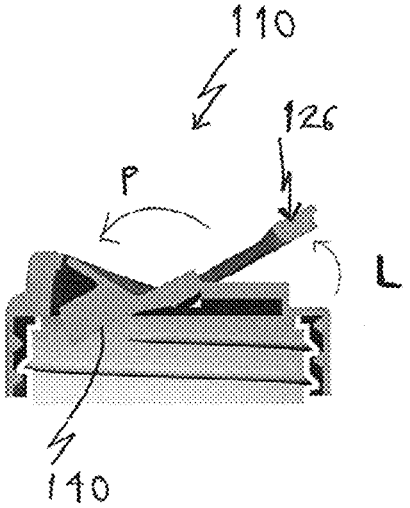
FIG. 11 is a section of the cap of FIGS. 8 to 10 with a closure member shown in a partially opened position.
Figure 12:
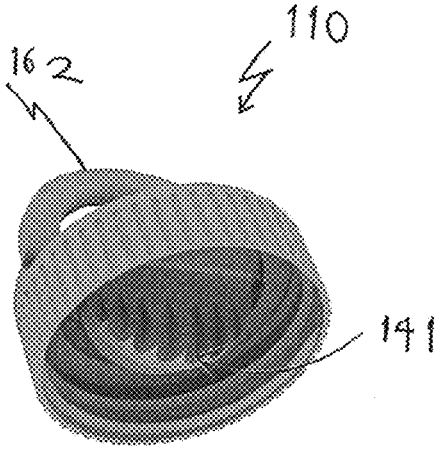
FIG. 12 is an underplan perspective view of the cap of FIG. 11 with the closure member having been further opened.
Figure 13:
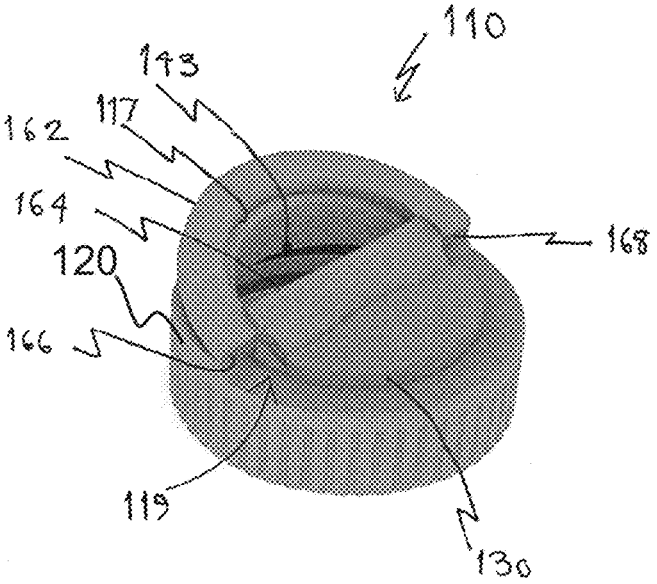
FIG. 13 is a perspective view of the cap of FIG. 12 with the closure member shown in a fully open position.
Figure 14:
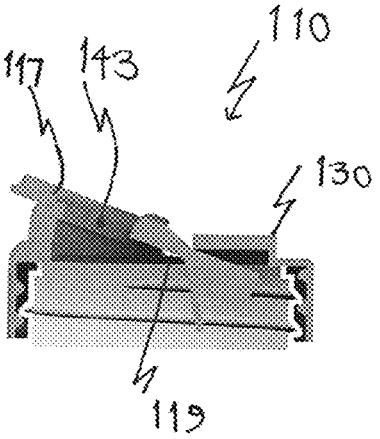
FIG. 14 is a section of the cap of FIG. 13.
Figure 16:
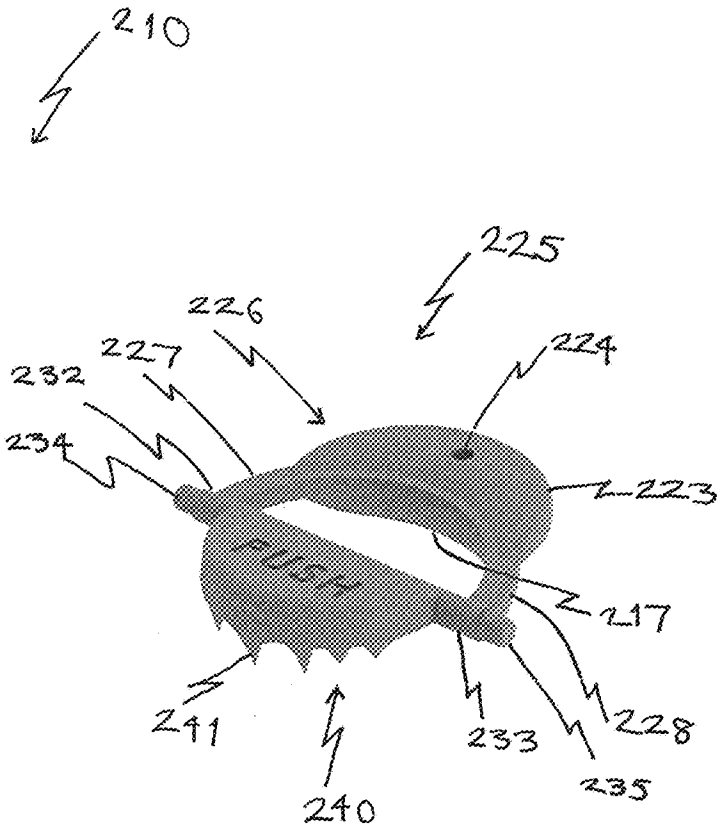
FIG. 16 is a perspective view of a closure member for use with the base of FIG. 15.
Figure 15:
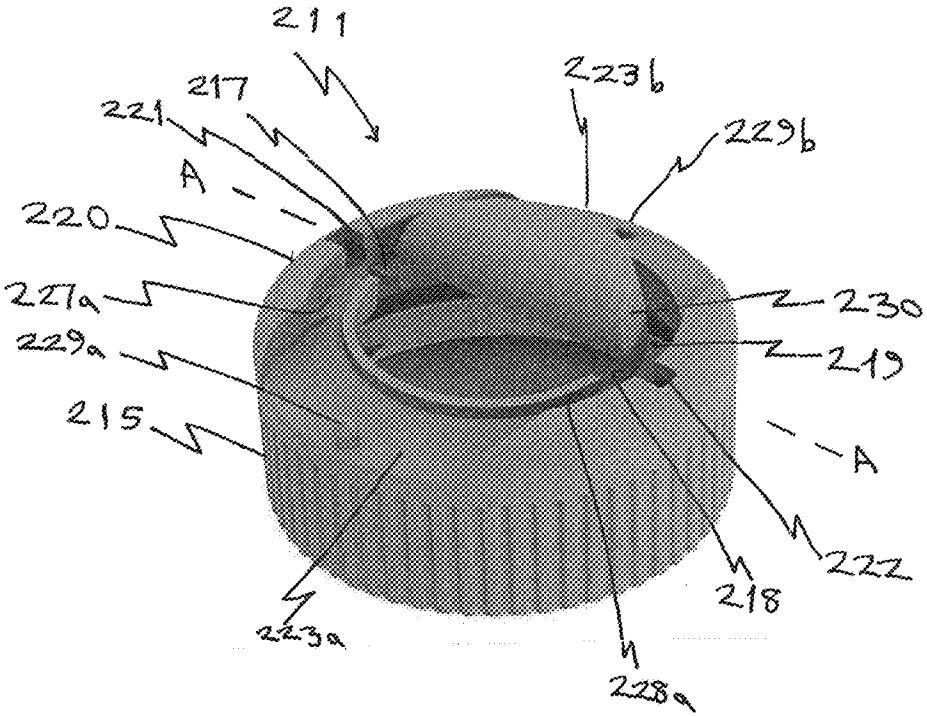
FIG. 15 is a perspective view of a cap base forming part of a further embodiment.
Figure 17:
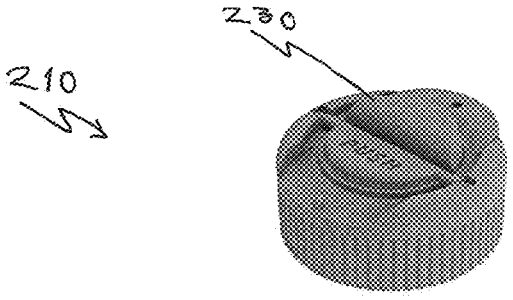
FIG. 17 is a perspective view of a closure formed from the base and closure of FIGS. 15 and 16.

In this embodiment the cutting part 140 includes a push tab 142 which can be pressed down as shown in FIG. 11. The spout 126 includes a single semi-circular strap 162 closed by a rectangular plate 164. The strap is connected to the flange 120 at either end in a film hinge arrangement 166, 168 so that it can be articulated when the tab 142 is pushed down.

In use the closure 125 is rotated by pushing (P) the tab 142 and lifting (L) the spout 126. This causes the plate teeth 141 to cut a container seal 156 (not present in this embodiment). In doing so the dispensing orifice 143 is formed. In addition, movement of the spout plate 164 reveals two opposed anti-glug orifices 119 and also the spout pouring lip 117 moves into position adjacent the dispensing orifice 143.

Referring now to FIGS. 15 to 20 there is shown a cap 210 formed according to an alternative embodiment.

The cap 210 has a similar structure and functionality to the cap 10.

The cap 210 comprises a base 211 with a generally cylindrical sidewall 215 which is open at one end and at the other end terminates with a flange 220 which extends radially inwards. The flange 220 carries a closure member 225 and a semi-circular raised deck 230.

The separate closure member 225 comprises a pouring spout section 226 including two arcuate arms 227, 228 connected to a crescent-shape tab 223. The spout and arms extend around the curved part of the deck 230 when the closure 225 is attached to the base 211.

The deck 230 is only connected to the flange 220 by a pair of central connectors 217, 218 and this creates an arcuate gap 219 between the flange and the deck. The spout 226 and arms 227, 228 are seated in the gap 219 in the closed position.

The arms 227, 228 join the spout 226 to central, laterally extending pivot arms 232, 233. Each arm 232, 233 carries a pivot pin 234, 235. The pins 234, 235 clip into rebates 221, 222 in the flange 220.

The flange 220 supports a recess on the opposite side of the cap which has parts 227*a*, 228*a* and 223*a* shaped correspondingly with the arms 227, 228 and a tab 223 forming part of the spout 226.

The flange 220 also has a recess 223*b* shaped correspondingly to the spout tab 223 opposite the recess part 223*a*. In the closed position the spout tab 223 rests in the recess 223*b*.

The recesses 223*a*, 223*b* have central projections 229*a*, 229*b* which are received in a hole 224 in the spout tab 223.

At the other side of the arms 232, 233 a semi-circular cutting plate 240 is provided. The periphery of the underside of the curved part of the plate 240 is provided with a plurality of cutting teeth 241.

The cap 210 is attachable to a container neck 250. For this purpose the interior of the cap sidewall 215 is provided with a screw thread 216 and the neck 250 has a corresponding external screw thread 252 so that the cap can be screwed onto the neck. The circular neck opening 254 is closed by a seal 256, which in this embodiment is a laminar panel in the form of an induction heat sealed seal.

Figure 18:
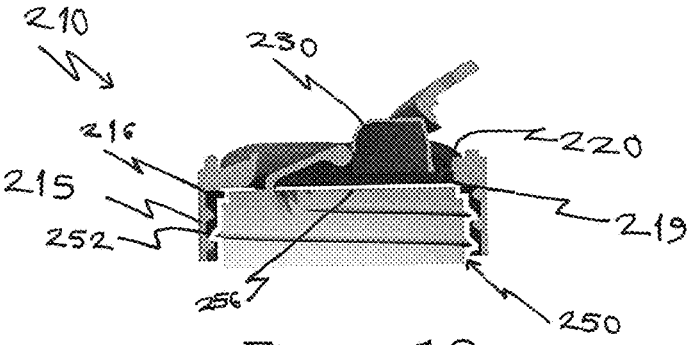
FIG. 18 is a section of the closure of FIG. 17 with the closure member shown in a partially opened position.

As shown in FIG. 18, if the spout tab 223 is lifted the whole closure 225 pivots in the direction R about the lateral axis A as the pins 234, 235 rotate in the rebates 221, 222. The spout wall 217 (also referred to as central connector 217) and arms 227, 228 are lifted out of the gap 219. There is no or substantially no relative movement between the two halves of the closure 225, so as the spout and arms rotate "up" the cutting plate 240 starts to rotate "down".

As the plate 240 rotates the teeth 241 contact the container seal 256 and cut through it. The closure is further rotated to complete the cutting. As the cutting plate moves a dispensing orifice 243 is defined.

Figure 19:
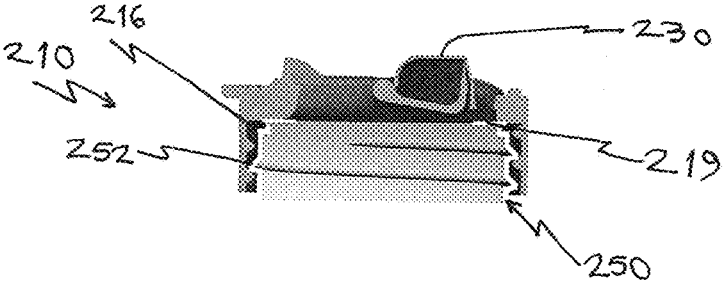
FIG. 19 is a section of the closure of FIG. 18 with the closure shown in a fully opened position.
Figure 20:
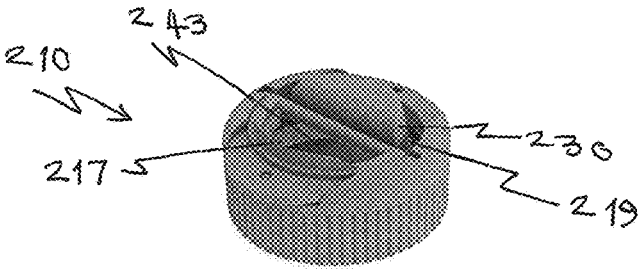
FIG. 20 is a perspective view of the closure of FIG. 19.

In the open position shown in FIGS. 19 and 20 the closure has been rotated approximately 180 degrees. The spout tab 223 fits into the flange recess 22 and the spout wall 217 now sits around the newly formed dispensing orifice 243 and serves as a pouring lip over which product can flow in use. The cutting teeth 241 fit up inside the underside of the deck 230. The gap 219 is unblocked and can serve as an anti-glug orifice in use.

The closure member is therefore "flipped" over and in this embodiment is inverted. The flipping causes cutting of a seal, creation of a dispensing orifice, positioning of a pouring spout adjacent the dispensing orifice and unblocking of an anti-glug orifice.

Although illustrative embodiments of the invention have been disclosed in detail herein, with reference to the accompanying drawings, it is understood that the invention is not limited to the precise embodiment shown and that various changes and modifications can be affected therein by one skilled in the art without departing from the scope of the invention as defined by the appended claims and their equivalents.

The invention claimed is:

1. A liner-piercing dispensing cap comprising a body with a dispensing orifice, and a closure member, the closure member rotatable relative to the body from a closed position in which the dispensing orifice is closed to an open position in which the dispensing orifice is open, in which the closure member includes breaching means for breaching a container seal, in which the closure member is turnable about a lateral axis, said lateral axis extending generally across a center of the dispensing orifice, in which the closure member comprises a pouring spout on one side of the lateral axis which receives flow from the dispensing orifice in use, in which the breaching means is provided on an other side of the lateral axis, in which the closure member is invertable to open the dispensing orifice and to cause breaching of the seal, and in which said closure member turns through more than 90 degrees from the closed position to the open position and to a position beyond vertical relative to said body.

2. The cap as claimed in claim 1, in which the cap is formed as a single-piece article.

3. The cap as claimed in claim 1, in which the closure member turns through approximately 180 degrees from the closed position to the open position.

4. The cap as claimed in claim 1, in which the closure member is located substantially completely within a periphery of the cap in the closed position.

5. The cap as claimed in claim 1, in which the closure member is located substantially completely within a periphery of the cap in the open position.

6. The cap as claimed in claim 1, in which the cap is generally cylindrical.

7. The cap as claimed in claim 1, in which the cap includes engagement means for attaching it to a container.

8. The cap as claimed in claim 1, in which the cap comprises an anti-glug orifice.

9. The cap as claimed in claim 1, in which the cap is a two-part structure and the body is separate from the closure member.

10. The dispensing cap as claimed in claim 1, in which the breaching means is a cutter or a slicer.

11. The dispensing cap as claimed in claim 1, in which the breaching means comprises a cutting plate.

12. The cap as claimed in claim 1, in which the dispensing orifice is generally circular, and in which the lateral axis extends generally diametrically across the orifice.

13. The cap as claimed in claim 1, in which placement of a point of rotation for the closure member is in a center of the cap.

14. A liner-piercing dispensing cap comprising a body with a dispensing orifice, and a closure member, the closure member rotatable relative to the body from a closed position in which the dispensing orifice is closed to an open position in which the dispensing orifice is open, in which the closure member includes breaching means for breaching a container seal, in which the closure member is invertable to open the dispensing orifice and to cause breaching of the seal, in which the cap comprises an anti-glug orifice, in which in the closed position the anti-glug orifice is blocked by the closure member and in the open position the anti-glug orifice is unblocked, in which the closure member is part of an upper surface of the cap, and in which said closure member turns through more than 90 degrees from the closed position to the open position and to a position beyond vertical relative to said body.

15. The cap as claimed in claim 14, in which the breaching means is arranged to breach the seal at or in a region of an outside diameter thereof.

16. The cap as claimed in claim 14, in which the closure member turns through approximately 180 degrees from the closed position to the open position.

17. A dispensing cap comprising a dispensing orifice and an anti-glug orifice, the cap further comprising a closure member movable from a closed position to an open position, in which in the closed position the anti-glug orifice is blocked by the closure member and the dispensing orifice is closed, and in the open position the dispensing orifice is open and the anti-glug orifice is unblocked, and in which the closure member is turnable about an axis, said axis extending generally across a center of the dispensing orifice.

18. A combination of a container and a liner-piercing dispensing cap, the dispensing cap comprising a body with a dispensing orifice, and a closure member, the closure member rotatable relative to the body from a closed position in which the dispensing orifice is closed to an open position in which the dispensing orifice is open, in which the closure member includes breaching means for breaching a seal of the container, in which the closure member is turnable about a lateral axis, said lateral axis extending generally across a center of the dispensing orifice, in which the closure member comprises a pouring spout on one side of the lateral axis which receives flow from the dispensing orifice in use, in which the breaching means is provided on an other side of the lateral axis, in which the closure member is invertable to open the dispensing orifice and to cause breaching of the seal, and in which said closure member turns through more than 90 degrees from the closed position to the open position and to a position beyond vertical relative to said body.

19. The combination as claimed in claim 18, in which the closure member turns through approximately 180 degrees from the closed position to the open position.

20. A liner-piercing dispensing cap comprising a body with a dispensing orifice, and a closure member, the closure member rotatable relative to the body from a closed position in which the dispensing orifice is closed to an open position in which the dispensing orifice is open, in which the closure member includes breaching means for breaching a container seal, in which the closure member is turnable about a lateral axis, in which the closure member comprises a pouring spout on one side of the lateral axis which receives flow from the dispensing orifice in use, in which the breaching means is provided on an other side of the lateral axis, in which the closure member is invertable to open the dispensing orifice and to cause breaching of the seal, in which said closure member turns through more than 90 degrees from the closed position to the open position and to a position beyond vertical relative to said body, and in which the closure member is part of an upper surface of the cap.

* * * * *